United States Patent [19]

Kojima et al.

[11] Patent Number: 4,773,206

[45] Date of Patent: Sep. 27, 1988

[54] FALSE-TWIST TEXTURED YARN OF POLYAMIDE AND METHOD AND APPARATUS FOR PRODUCING THE SAME

[75] Inventors: Teiryo Kojima; Heiichiro Matsuda; Masaru Tokizane, all of Tokyo, Japan

[73] Assignee: Toray Industries, Inc., Tokyo, Japan

[21] Appl. No.: 2,796

[22] Filed: Jan. 13, 1987

Related U.S. Application Data

[62] Division of Ser. No. 679,305, Dec. 7, 1984, Pat. No. 4,682,465.

[30] Foreign Application Priority Data

Dec. 7, 1983 [JP] Japan ..... 58-229936

[51] Int. Cl.[4] ..... D02G 1/00

[52] U.S. Cl. ..... 57/288

[58] Field of Search ..... 57/243, 247, 282, 284, 57/286, 287, 288, 292; 428/373

[56] References Cited

U.S. PATENT DOCUMENTS

| | | | |
|---|---|---|---|
| 2,295,593 | 9/1942 | Miles | 57/247 |
| 2,771,733 | 11/1956 | Leath et al. | 57/247 |
| 2,796,655 | 3/1972 | Stuewer | 57/247 X |
| 3,646,747 | 3/1972 | Strohmaier | 57/247 X |
| 3,651,633 | 3/1972 | Steinmiller | 57/247 |
| 3,698,178 | 10/1972 | Iwoka et al. | 57/247 X |
| 3,939,637 | 2/1976 | Franz et al. | 57/247 |
| 3,994,121 | 11/1976 | Adams | 57/243 |
| 3,995,420 | 12/1976 | Ohse et al. | 57/247 |
| 4,019,311 | 4/1977 | Schippers | 57/247 X |
| 4,229,500 | 10/1980 | Adachi et al. | 428/373 X |

*Primary Examiner*—Donald Watkins

*Attorney, Agent, or Firm*—Austin R. Miller

[57] ABSTRACT

A false-twist textured yarn composed of a polyamide filament yarn excellent in stretchability and heat durability suitable for sports wear is proposed, which is characterized in that the maximum value F (g) of a shrinkage force under dry heat and a heat treatment temperature T (°C.), at which the maximum value F is attained, are defined by the following equations:

$$0.20D \geqq F \geqq 0.08D, \text{ and}$$

$$Tm > T \geqq Tm - 25$$

wherein D is a titre of the textured yarn represented by denier, and Tm is a melt-breakage temperature of the polyamide filament yarn represented by °C., and that the crimp recovery CR is 15% or more. The textured yarn is preferably produced from a preoriented undrawn polyamide filament under a specific false-twist texturing conditions by means of an in-draw texturing machine with a specific yarn guide for facilitating a threading operation.

9 Claims, 4 Drawing Sheets

FALSE-TWIST TEXTURED YARN OF POLYAMIDE AND METHOD AND APPARATUS FOR PRODUCING THE SAME

This is a division, of application Ser. No. 679,305, filed Dec. 7, 1984 now U.S. Pat. No. 4,687,465.

BACKGROUND OF THE INVENTION

1. Field of the Invention

The present invention relates to a false-twist textured yarn of a polyamide and a method and an apparatus for the production thereof. More particularly, the present invention relates to a false-twisted textured yarn of a polyamide having a high crimp development ability and being excellent in heat durability, and a method and apparatus for the production thereof.

2. Description of the Related Art

False-twist textured yarns of polyamides have been known from old, and they are superior to false-twist textured yarns of polyesters and other polymers in stretchability and they are widely used for the production of woven and knitted stretch fabrics. However, with increase of the grade of sportswear, requirements for stretch materials become severer and presently available false-twist textured yarns of polyamides hardly satisfy these requirements. In the field of clothes for which an especially high stretchability is required, a false-twist textured yarn of a polyamide is mix-woven or mix-knitted with a polyurethane yarn. This, however, results in increase of the manufacturing cost.

In one of methods for obtaining a high-stretch yarn without using a polyurethane yarn, two single yarns to which primary twists have been imparted are doubled, the doubled yarn is strongly twisted in the direction reverse to the direction of the initial twists, the twisted yarn is thermally set and the yarn is then detwisted so that the detwist number is substantially equal to the number of the final twists (see Japanese Examined Patent Publication (Kokoku) No. 33-6699).

A yarn having a high stretchability can be obtained according to this method. However, this method is defective in that the processing steps are complicated and the manufacturing cost becomes high.

There has been proposed another method in which a preoriented undrawn yarn (POY) is false-twisted with a large false-twist number (see Japanese Unexamined Patent Publication (Kokai) No. 50-42152). Though the manufacturing cost can be reduced in this method as compared with that in the former method, the stretchability of the obtained textured yarn is lower than that of the textured yarn obtained according to the former method, because high twists cannot be given to the POY.

For producing a false-twist textured yarn of polyamide at a high speed, there is widely adopted an in-draw texturing system in which a preoriented undrawn yarn (POY) is false-twisted simultaneously with drawing. In fact, when a friction type twister is utilized in this system, the processing speed is as high as 600 to 1000 m/min. On the other hand, the spinning speed of POY is going to reach a level of 3000 to 4000 m/min. However, the recent needs for higher productivity require further increase of both the false-twist texturing speed and the spinning speed of POY. Various problems should be solved before attaining this object. One of these problems is how to avoid occurrence of fluffs in a false-twisted textured yarn with increase of the false-twist texturing speed. This disadvantage becomes particularly serious when POY spun at a high spinning speed is utilized. The reason is presumed to be that the elongation of POY is reduced with increase of the spinning speed thereof. Moreover, if the titre of the yarn is increased, generation of fluffs becomes conspicuous. The reason is that if the titre is increased, the difference of the yarn length between the inner and outer layers of the yarn is increased and therefore, the outer layer of the yarn is strongly elongated and finally broken to readily cause fluffs.

The length of the yarn path in a false-twist texturing machine tends to be increased with the increase of the texturing speed and now reaches 4 to 5 m or more. Because of the limitation of the ceiling height in a mill, it is difficult to form such a long yarn path linearly in the vertical direction. Accordingly, as shown in FIG. 3, a false-twist texturing machine in which a primary heater 2 and a cooling device 3 are obliquely arranged is often adopted at the present. In view of the facility of the threading operation, it is preferred that a first feed roller 1 and a twister 4 be arranged within reach of the operator's hands. Therefore, a considerable distance more than 50 cm is produced between the first feed roller 1 and the entrance of the primary heater 2 and ballooning of the yarn tends to occur at that area. To prevent occurrence of ballooning of the yarn, a rotary type twist stopping member called "vane tensor" as shown in FIG. 4 is disposed in the vicinity of the entrance of the primary heater 2. However, this rotary member tends to increase formation of fluffs in the resultant false-twist textured yarn.

As pointed out hereinbefore, formation of fluffs in a false-twist textured yarn is aggravated by any of the following false-twist texturing conditions:

(1) High speed processing.

(2) Usage of POY spun at a high spinning speed.

(3) Usage of a yarn of a large titre.

(4) Usage of a false-twist texturing machine in which the distance between the first feed roller and the entrance of the primary heater is large.

Namely, according to any of the conventional techniques, it is difficult to perform the false-twist texturing operation of POY and obtain a desired textured yarn having a titre of more than 30 denier at a processing speed of at least 600 m/min and a draw ratio lower than 1.35 by using a false-twist texturing machine in which the distance between the first feed roller and the entrance of the primary heater is 50 cm or more.

There has been proposed a method in which instead of the above-mentioned rotary twist stopping member, yarn guide elements for forming a bending yarn path are disposed between the primary heater and the first feed roller to reduce the twist ascent to the first feed roller (see Japanese Examined Patent Publication (Kokoku) No. 53-7976). According to this method, formation of fluffs and reduction of strength are prevented (such the drawbacks are thought to be caused by partial drawing of the yarn and deformation of the yarn section at the nip point of the first feed roller), but the capacity of inhibiting the twist ascent is poor and this method is not suitable for attaining the object of the present invention. It is considered that, to enhance the capacity of inhibiting the twist ascent by this method, the number of yarn guide elements must be increased for further bending of the yarn path. However, this causes an increase of the resistance to running yarn as well as difficulty of the smooth threading.

There has been proposed still another method in which a satin-plated bar guide for bending the yarn path between the heater and the feed roller is disposed in the non-rotary state 200 to 450 mm before the ordinary yarn path and the yarn is half wrapped on this bar guide and turned back (see Japanese Examined Patent Publication (Kokoku) No. 58-48649). According to this method, the distance of the yarn path between the feed roller and the heater is prolonged by turning-back of the yarn, whereby uneven distribution of twists is prevented, causing the decrease of fluffs in the resultant yarn. However, this bar guide has no function of stopping twist ascent and of preventing occurrence of yarn ballooning. Furthermore, in this known method, the yarn tends to be flattened just at the beginning of false-twist texturing and to adhere to the guide. Especially in case of POY, yarn breakage is caused at that time.

A still further method has been proposed in Japanese Unexamined Patent Publication (Kokai) No. 50-42152, for preventing formation of fluffs in the draw-texturing process, in which double twisted portions of at least 3 per cm of yarn length are forcibly formed in a yarn being passing through the twisting zone of the process. This method is effective only when the false-twist texturing speed is as low as about 100 to about 200 m/min , but, at such a high speed as 600 m/min or more, the texturing operation becomes unstable and the yarn breakage is increased.

SUMMARY OF THE INVENTION

It is a primary object of the present invention to provide a false-twist textured yarn composed of a continuous polyamide filament yarn, which can be suitably utilized for making a knitted or woven fabric excellent in the stretchability, and a method and apparatus for the production thereof. More specifically, the present invention provides a false-twist textured yarn having less fluffs even if the false-twist texturing operation is carried out at a high speed by using a false-twist texturing machine having such a yarn path that the distance between the first feed roller and the entrance of the primary heater is 50 cm or more.

In accordance with a first aspect of the present invention, there is provided a false-twist textured yarn composed of a continuous polyamide filament yarn, characterized in that the maximum value F (g) of a shrinkage force under dry heat and a heat treatment temperature T, at which the maximum value F is attained, are defined by the following equations:

$$0.20\,D \geqq F \geqq 0.081, \text{ and}$$

$$Tm \geqq T \geqq TM - 25$$

wherein D is a titre of the textured yarn represented by denier and Tm is a melt-breakage temperature of the polyamide filament yarn represented by °C., and that the crimp recovery CR is 15% or more.

In accordance with a second aspect of the present invention, there is provided a false-twist textured yarn as set forth above, wherein the textured yarn has a cohesive lubricant agent containing a wax having a high melting point.

In accordance with a third aspect of the present invention, there is provided a method for producing a false-twist textured yarn from a starting continuous polyamide filament yarn by a false-twist texturing machine. The method is characterized in that the birefringence Δn of the starting filament yarn to be fed to the texturing machine, the yarn tension t (g/d) in a twisting zone of the texturing machine and the heat setting temperature H (°C.) are defined by the following equations:

$$\Delta n \geqq 35 \times 10^{-3},$$

$$0.8 \geqq t \geqq 0.4, \text{ and}$$

$$Hm - 10 \geqq H \geqq Hm - 25,$$

wherein Hm is a melting point (°C.) of said filament yarn after it is fully drawn.

In accordance with a fourth aspect of the present invention, there is provided a method for producing a false-twist textured yarn from a preoriented undrawn continuous polyamide filament yarn by a false-twist texturing machine. The filament yarn has a birefringence Δn of at least $35 \times 10^{-3}$ and is treated with a cohesive lubricant agent containing a wax having a high melting point. The method is characterized in that in-draw texturing system is carried out by utilizing a friction twister of belt nip type under a false-twist condition represented by the following equation:

$$N \cdot \sqrt{D} \geqq 28{,}000,$$

wherein N is a false twist number (t/m) and D is a total denier of the resultant textured yarn.

In accordance with a fifth aspect of the present invention, there is provided a method for starting the production of a false-twist textured yarn from a preoriented undrawn continuous polyamide multifilament yarn by an in-draw texturing machine. The multifilament yarn has a birefringence Δn of at least $35 \times 10^{-3}$ and the in-draw false-twist texturing machine comprises a first feed roller, a primary heater disposed downstream of the former at a point separate by 50 cm or more from the feed roller and means for providing a bending yarn path between the first feed roller and the primary heater by a plurality of yarn guide elements. The method is characterized in that the multifilament yarn is threaded to at least one of said yarn guide elements, disposed upstream of said primary heater within a distance of less than 20 cm, whereby the multifilament yarn is caused to travel into the heater and be twisted and heated therein, and thereafter, the multifilament is threaded to the remaining yarn guide elements to form the yarn path bending zigzag with a total wrapping angle around said yarn guide elements being more than 300 degrees.

In accordance with a sixth aspect of the present invention, there is provided a false-twist texturing machine for processing a filament yarn at a high speed, which comprises a first feed roller, a primary heater, a false-twister, a second feed roller and a winding means. The texturing machine is characterized in that two groups A and B of yarn guide elements, the two groups of the yarn guide elements being secured on separate brackets, are disposed upstream of the primary heater in the vicinity of an entrance thereof, and at least one of the brackets is movable toward and apart from the other bracket so that said yarn guide elements on the respective brackets co-operatively constitute a yarn path bending zigzag.

BRIEF DESCRIPTION OF THE DRAWINGS

Other objects and advantages of the present invention will be more apparent from the following description by referrrng to the attached drawings illustrating preferred embodiments of the present invention, wherein.

DESCRIPTION OF THE PREFERRED EMBODIMENTS

The present invention will now be described in detail.

In the first aspect of the present invention, the shrinkage force under dry heat is measured by a thermal stress measuring apparatus (Model KE-1 supplied by Kanebo Engineering K.K.) under the following conditions.

Sample length: 20 cm (in a loop form)

Temperature-elevating rate: 120 seconds/300° C.

Initial load: 0.1 g/d

Measurement frequency: 5 times

Figure 1:
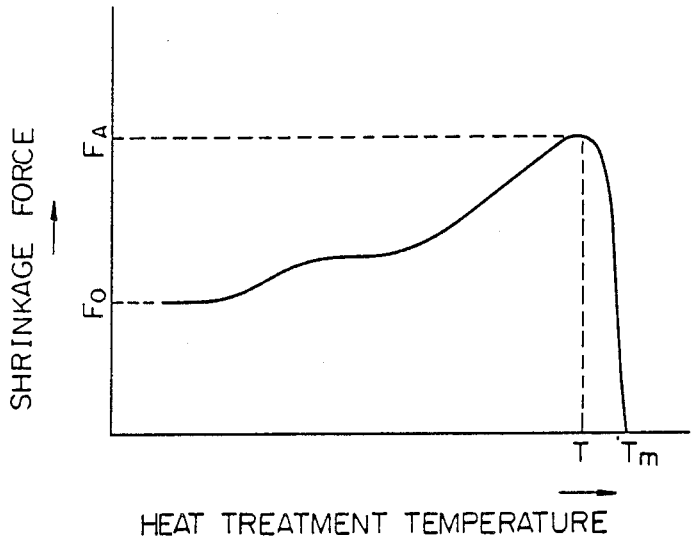
FIG. 1 is a graph depicting the relationship between the heat treatment temperature and the shrinkage force of a polyamide filament.

An example of the measurement is shown in FIG. 1. The maximum value F (g) of the shrinkage force is determined by reading the apparent maximum value $F_A$ (g) of the shrinkage force in FIG. 1, subtracting the initial tension $F_O$ (g) from the read value and dividing the obtained value by two. Namely, the maximum value F of the shrinkage force under dry heat is expressed by the following formula:

$$F=\tfrac{1}{2}(F_A-F_O)$$

The heat treatment temperature T (°C.) is the temperature at which said apparent maximum value $F_A$ of the shrinkage force is attained, and the melt-breakage temperature Tm (°C.) is the temperature at which the shrinkage force is zero (see FIG. 1).

The crimp recovery CR (%) is determined on a sample pretreated under the following conditions according to the test method of JIS L-1090.

(1) An initial load of 2 mg/d per denier is hung down from a small hank of a textured yarn to be tested.

(2) The hank is immersed in hot water maintained at 98°±1° C. for 20 minutes while the initial load is imposed on the hank.

(3) The hank is taken out from hot water and the initial load is removed, and the hank is allowed to stand in the stationary state for more than about 12 hours so that the hank is not disturbed, whereby the water equilibrium state is attained.

(4) A lighter load of 2 mg/d is applied to the treated hank and then a heavier load of 0.1 g/d is added thereto. The crimp recovery CR is calculated according to the following formula:

$$CR(\%)=[(l-l_1)/l]\times 100$$

wherein l stands for the length of the hank under the lighter plus heavier loads and $l_1$ stands for the length of the hank under the lighter load alone.

Nylon-6 and nylon-66 may be used for the continuous polyamide filament yarn in the present invention. The denier and filament number are not particularly critical, but ordinarily, the denier is in the range of from about 10 for stockings to about 400 for industrial materials and the filament number is in the range of from 2 for stockings to 144 for industrial materials.

The first characteristic feature of the present invention resides in that the maximum value F (g) of the shrinkage force under dry heat is in the range represented by the following equation:

$$0.20\ D \geqq F \geqq 0.08\ D$$

The value F of a conventional false-twist textured yarn composed of a continuous polyamide filament yarn is smaller than 0.06 D. This value F has a relation to the crimp developing ability, by which the textured yarn can develop its latent crimps in a woven or knitted fabric against the restriction caused by the structure of the woven or knitted fabric. The present inventors made investigations with a view to improve the stretchability of a woven or knitted fabric composed of a false-twist textured yarn of a polyamide, and found that one condition for attaining this object resides in increase of the crimp developing ability of the false-twist textured yarn in a woven or knitted fabric. It also was found that in order to increase this crimp developing ability, it is necessary to increase the value F. Especially in the case where the false-twist textured yarn is used for a product for which a high stretchability is required, such as tights or a swimming suit, the value F should be at least 0.08 D. However, if the value F is excessively large, a problem of a poor dimensional stability arises. Accordingly, it is indispensable that the value F should be up to 0.20 D.

The second characteristic feature of the present invention resides in that the heat treatment temperature T (°C.) at which the maximum value F (g) of the shrinkage force under dry heat is attained is in the range represented by the following equation:

$$Tm \geqq T \geqq Tm-25.$$

The temperature T of a conventional false-twist textured yarn of a polyamide is about (Tm−40) and the difference of this temperature T from the melt-breakage temperature Tm is large. In contrast, in the false-twist textured polyamide yarn of the present invention, the difference between T and Tm is small. The value of Tm is substantially constant for one polymer. Accordingly, if the kind of the polymer is the same, the value T of the false-twist textured polyamide yarn of the present invention is larger than that of the conventional false-twist textured polyamide yarn. The value T has an influence on the thermal stability of the false-twist textured yarn, and, therefore, it is apparent the thermal stability of the false-twist textured polyamide yarn according to the present invention is higher than that of the conventional one.

The third characteristic feature of the present invention resides in that the crimp recovery CR (%) is 15% or more. The CR value is a measure indicating the degree of crimp, and in order to attain a sufficient stretchability, it is indispensable that this condition should be satisfied. Namely, it is important that the CR value should be 15% or more while the above-mentioned two requirements are satisfied.

The second aspect of the present invention will now be described.

By the term "wax having a high melting point" is meant a wax having a melting point higher than 90° C. Examples thereof are polyethylene wax, polypropylene wax, oxidized paraffin wax and microcrystalline wax. It is indispensable that the wax should be incorporated in the cohesive lubricant agent in an amount of at least 3%, preferably at least 8% by weight. Of course, an emulsifier and an antistatic agent may be incorporated n the lubricant agent in addition to the wax. In order to improve the adhering property of the wax, a mineral oil may be incorporated in the lubricant agent.

The cohesive lubricant agent containing the wax having high melting point should be applied when a preoriented undrawn polyamide filament yarn is melt-spun. The wax is present on the surface of the preoriented undrawn yarn and serves a function of bonding the respective filaments to one another. By the subsequent false-twist texturing processing, this bonding among the filaments are released and the wax component is allowed to flow appropriately, which enhances mutual slip among the filaments after texturized and improves a stretchability of the resultant yarn. If the wax is applied after the false-twist texturing, the bonding among the filaments is not released, and the touch of the resulting knitted or woven fabric becomes rough and hard and the stretchability is not improved. The wax component should have a high melting point exceeding 90° C. The reason is that the residual ratio of the wax component after scouring or washing is influenced by the melting point. Namely, if a wax having a melting point lower than 90° C., such as paraffin wax or ester type wax, is used, the wax residual ratio after scouring becomes very low.

The third aspect of the present invention will now be described.

A false-twist texturing machine comprising feed rollers, a heat treating device, a false-twister and a winder may be used in this aspect. A false-twister in which the ratio of the detwisting tension to the twisting tension can be set to less, than 1.2 is preferably used. In this connection, a pin type false-twister is not preferred. It is indispensable that a continuous filament yarn of a polyamide to be fed in the present invention should have a birefringence $\Delta n$ of at least $35\times10^{-3}$. The method of the present invention can be carried out by processing a fully drawn yarn by means of a conventional false-twist texturing machine or by processing an undrawn yarn, especially POY, by means of an in-draw false-twist texturing machine.

In the present invention, the yarn tension t (g/d) should be adjusted within the range represented by the following equation:

$$0.8 \geqq t \geqq 0.4$$

The value t within the above-mentioned range is much larger than that adopted in the conventional false-twist texturing method. According to the conventional technique, the value t is ordinarily 0.1 to 0.12 in case of the pin-type false-twister and does not exceed 0.4 even in case of the friction-type false-twister. In general, increase of the twisting tension results in increase of the detwisting tension and reduction of the crimp recovery. Therefore, it has been considered that the twisting tension should be reduced as low as possible provided the processing stability is maintained. The requirement of $0.8 = \geqq t \geqq 0.4$ is contrary to this conventional concept. However, if this requirement is combined with the requirement of the heat setting temperature H described hereinafter, a special effect not heretofore expected can be attained.

In the method for producing a false-twist textured polyamide yarn according to the present invention, the heat setting temperature H should be adjusted within the range represented by the following equation:

$$Hm-10 \geqq H \geqq Hm-25$$

wherein Hm stands for the melting point (°C.) of the continuous polyamide filament yarn after it is fully drawn.

The value H customarily adopted in the conventional false-twist texturing method does not exceed the level of (Hm−30). The heat setting temperature H corresponds to the surface temperature of a heater of a false-twist texturing machine. If the heater temperature is excessively elevated, fusion bonding is caused among filaments and the appearance and crimp characteristics of the resultant textured yarn are degraded. In the conventional concept, it has been considered that an ordinary textured yarn cannot be obtained if the heater temperature is higher than (Hm−25). The requirement of $Hm-10 \geqq H \geqq Hm-25$ according to the present invention is contrary to the generally accepted concept.

If one of the yarn tension requirement of $0.8 \geqq t \geqq 0.4$ and the heat setting temperature requirement of $Hm-10 \geqq H \geqq Hm-25$ is satisfied alone, only a textured yarn having a low crimp recovery and/or an appearance degraded by fusion bonding is obtained. To our great surprise, it was found that when both of the abovementioned requirements are simultaneously satisfied, a false-twist textured yarn free of fusion bonding or low crimp recovery can be obtained. The present invention has been completed based on this finding. In the method of the present invention, there is not any limitation of the false-twist texturing speed or the like, other than the above-mentioned requirements. However, especially excellent effects can be attained when the processing speed is 600 to 1000 m/min.

The cohesive lubricant agent containing a high-melting point wax, which is used in the fourth aspect of the present invention, is the same as the wax-containing lubricant agent described hereinbefore with respect to the second aspect of the present invention. In the fourth aspect of the present invention, it is preferred that the birefringence $\Delta n$ of the starting preoriented undrawn polyamide filament yarn (POY) be at least $35\times10^{-3}$. The nip-type friction twister used in the method of the present invention comprises a pair of elements such as belts, discs or rollers arranged to confront each other, and the yarn passing between the paired elements is gripped from both the sides by the elements and the yarn is twisted and propelled by the action of the elements.

In the present invention, the relation represented by the following equation should be established between the false twist number N and the denier D of the false-twist textured yarn:

$$N \cdot \sqrt{D} \geqq 28{,}000$$

It is well-known that the crimp size of a textured yarn decreases with increase of the false twist number. If this value is smaller than 28,000, crimps are coarse and an intended high stretchability cannot be obtained.

In the present invention, a false-twist texturing machine provided with a belt-nip-type friction twister is preferably utilized. The reason is that this type of the twister gives not only a twisting action but also propelling action to a yarn as same as a disc type friction twister consisting of three rotating axes and is hence suitable for high speed false-twist texturing. Further, the belt-nip-type twister has an excellent yarn-gripping ability, which is important to the present invention. Namely, in order to satisfactorily texture an undrawn polyamide filament yarn treated with the cohesive lubricant agent containing the high-melting-point wax with a high false twist number matching with the requirement of $N \cdot D \geqq 28{,}000$, it is necessary to use a twister having a high yarn-gripping ability. From this viewpoint, use of a belt-nip-type friction twister is significant. Also, a preoriented undrawn yarn is suitably utilized due to its easy twistability. In the present invention, a known draw ratio may optionally be adopted in the in-draw texturing process without any limitation.

The fifth and sixth aspects of the present invention will now be described with reference to embodiments illustrated in the accompanying drawings.

Figure 2A:
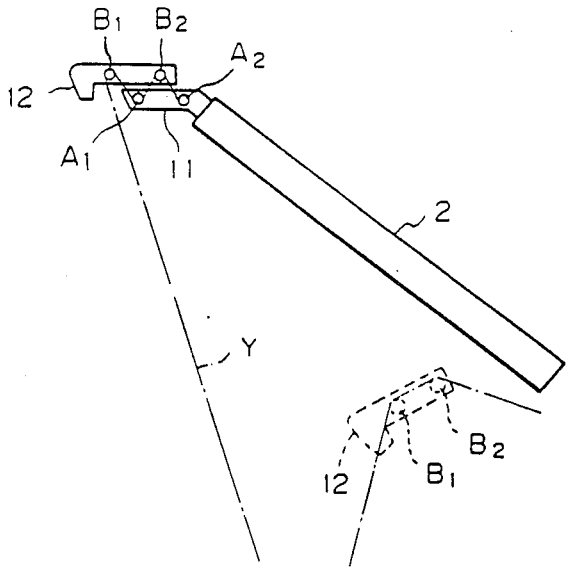
FIG. 2A is a schematic side view of an embodiment of a yarn guide utilized for the present invention, especially for the fifth and sixth aspects thereof.

FIG. 2A shows the vicinity of an entrance of a primary heater of the high-speed false-twist texturing machine of the present invention.

A movable bracket 12 to which guide elements Bl and B2 are attached is located at a right lower position indicated by a dot line, and in this state, threading, travelling and false-twisting of the yarn at the starting period are carried out. Then, the movable bracket 12 is moved to a left upper position indicated by a solid line. At this point, the bracket 12 intersects a bracket 11, on which other guide elements $A_1$ and $A_2$ are attached. Accordingly, the yarn travels along a bent yarn path formed by the guide elements $A_2$, $B_2$, $A_1$ and $B_1$.

Figure 2B:
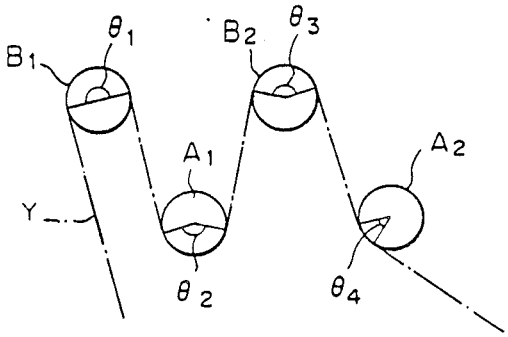
FIG. 2B is a partially enlarged view of FIG. 2A illustrating an arrangement of yarn guide elements.
Figure 3:
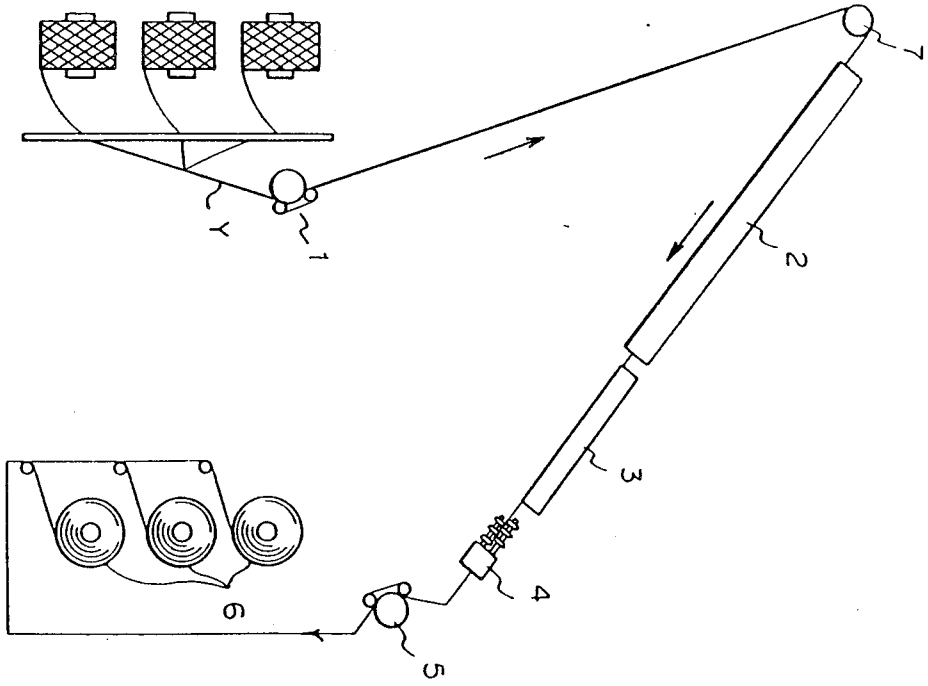
FIG. 3 is a schematic side view of a typical in-draw false-twist texturing machine, mainly illustrating a yarn path thereof.
Figure 4A:
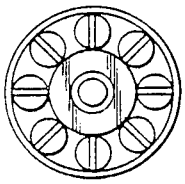
FIGS. 4A and 4B are side and front views of the conventional rotary type twist stopping member, respectively.
Figure 4B:
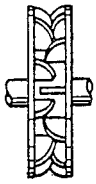

The entire structure of the false-twist texturing machine is illustrated in FIG. 3. A yarn Y taken out from a yarn drum passes through a first feed roller 1, a primary heater 2, a cooling device 3, a false-twister 4 and a second feed roller, 5 and is wound as a cheese 6. During this travel, the yarn Y is heated, twisted, cooled and detwisted, and thus a false-twist textured yarn is formed. A secondary heater and a third feed roller may be disposed subsequently to the second feed roller. In case of the false-twist texturing machine having the above-mentioned yarn path, a twist stopping member 7 is disposed between the first feed roller 1 and the entrance of the first heater 2 to prevent occurrence of ballooning due to the twist ascent from the twistrng zone to the first feed roller 1. The twist stopping member according to the present invention will now be described with reference to FIG. 2B. The twist stopping member consists of a plurality of yarn guide elements A1, A2, B1 and B2, each of which may be of the stationary type or of the rotary type forcibly rotated by running of the yarn. It is preferred that the guide elements be formed of a hard metal or ceramic having a smooth surface.

As the ceramic, alumina, titanium and zirconia types are preferred, and the surface roughness is preferably smaller than 04 S. The guide elements preferably have a drum-like shape with a groove of U-shaped cross-section. Further the diameter of the guide element corresponding to a yarn contact portion is preferably about 8 to about 15 mm.

The distance between the entrance of the primary heater 2 and the yarn guide element A2 closest thereto should be less than 20 cm. If this distance exceeds 20 cm, a balloon of the yarn is formed and the intended twist stopping function cannot be exerted. It is preferrable that the distance between the adjacent guide elements, B1 and A1, A1 and B2 or B2 and A2 along the yarn path (precisely, the distance between the points where the yarn separates from a surface of each guide element) is also less than 20 cm. If this distance exceeds 20 cm, the influence of a ballooning of the yarn cannot be neglected. FIG. 2B illustrates the yarn path after attaining the steady state of the false-twisting operation. The yarn is sequentially engaged with the yarn guide element B1, A1, B2 and A2 at wrapping angles $\theta 1$, $\theta 2$, $\theta 3$ and $\theta 4$, respectively. The total wrapping angle of $\theta 1+\theta 2+\theta 3+\theta 4$ should be more than 300 degrees. If the total wrapping angle is less than 300 degrees, the twist stopping effect becomes insufficient. On the contrary, if the total wrapping angle is too large, the resistance to the running yarn is increased and uneven drawing is caused. Accordingly, it is preferable that the total wrapping angle is less than 450 degrees. Furthermore, it is preferable that the wrapping angle of the upstream side guide element is always larger than that of the downstream side guide element and vice versa, so that the relation of $\theta 1>\theta 2>\theta 3>\theta 4$ is established.

In the case where the threading operation is carried out by using the above-mentioned yarn guide element, as shown in FIG. 3, the yarn Y taken out from the package is firstly nipped on the second feed roller 5 while the end of the yarn is being sucked by a suction pipe (not shown), whereby travelling of the yarn is started, and then, the yarn is sequentially engaged with the false-twister 4, the cooling device 3 and the primary heater 1 and is then engaged with the yarn guide elements A1, A2, B1 and B3 so that the total wrapping angle becomes more than 300 degrees. Then, the yarn end sucked by the suction pipe is transferred to the package 6 to start winding. In this method, it is preferable that the timing of nipping the yarn on the first feed roller 1 is preferably set just before or after the time when the yarn is engaged with the yarn guide elements.

In the above-mentioned threading operation, the total wrapping angle of more than 300 degrees should be attained after the travelling, twisting and heating of the yarn have been started. If the travelling, twisting and heating operations are started after formation of the total wrapping angle of more than 300 degrees, the frictional resistance to the yarn caused by the yarn guide elements becomes excessive to cause a yarn breakage and the threading operation cannot be performed smoothly. This is because non-twisted POY falls in contact, in the flattened state, with a circumference of the yarn guide elements corresponding to the wrapping angle of more than 300 degrees, and the friction coefficient therebetween is extremely increased. In addition to this, at the moment of yarn starting while keeping the yarn in contacting with the surfaces of the yarn guide elements, a static frictional force is imposed on the yarn from the guide elements, which also exerts an excessive travelling resistance to the yarn.

In order to carry out the above-mentioned threading operations more smoothly, the yarn guide elements A1 and A2 are attached to a stationary bracket 11 and the yarn guide elements B1 and B2 are attached to a movable bracket 12. At the initial stage of the threading operation, the movable bracket 12 is retreated to the position indicated by a dot line in FIG. 2A, and after travelling and twisting of the yarn are started, the movable bracket 12 is moved toward the stationary bracket 11 to contact the yarn with the primary heater 2, whereby heating is started. The movable bracket 12 is further advanced so that the yarn guide elements $B_1$ and $B_2$ form a zigzag yarn path in co-operation with the yarn guide elements $A_1$ and $A_2$ on the bracket 11, and the total wrapping angle of $\theta 1+\theta 2+\theta 3+\theta 4$ amounts to more than 300 degrees. In this case, though the function of causing the yarn to fall in contact with the primary heater and the function of forming the total wrapping angle of more than 300 degrees are both achieved by the movement of the movable bracket 12, the former function may be accomplished by another means irrelevant to the movable brackets.

One effect of the false-twisted textured yarn composed of the continuous polyamide filament yarn according to the first aspect of the present invention is that a fabric product obtained by using this textured yarn is excellent in the stretch characteristics.

It is apparent that a knitted or woven fabric which is sufficiently shrinkable at the dyeing step becomes a dyed fabric having a high stretchability. Since the false-twist textured yarn of the present invention has a very large maximum value F of shrinkage force, and a fabric made thereof can be sufficiently shrunk against the tension imposed in the dyeing step or the frictional restriction force acting between the adjacent yarns in the fabric structure, a fabricated product having high stretchability can be obtained. This product is excellent in stiffness (anti-drape). A fabric made of the conventional false-twist texturing yarn tends to largely reduce its stretchability during dyeing and heat setting. However, a fabric made of the yarn according to the present invention is improved in this regard and the stretchability thereof can be maintained for a long time even after the post heat treatment. Especially, the yarn according to the present invention is advantageous when it is mix-knitted with a non-stretch yarn such as cotton yarn or acrylic spun yarn for the production of socks, training wears and sports wears, because the false-twist textured yarn of the present invention can compensate for the low resiliency of the non-stretch yarn due to its sufficient stretchability.

The effect of the false-twist textured polyamide yarn according to the second aspect of the present invention is that a highly stretchable textured yarn, the properties of which are hardly changed by scouring, washing or the like, can be obtained.

One advantage of the method for producing a false-twist textured polyamide yarn according to the third aspect of the present invention is that the method can be carried out without any substantial change being made to the existing apparatus. Another advantage is that limitations to be imposed on increase of the processing speed are not serious. In general, as the processing speed is increased, the yarn tends to vibrate at respective parts of the yarn path to cause a so-called ballooning due to the increase of rotating speed, and the processing stability is disturbed. Accordingly, in the conventional process, for avoiding this disadvantage at the high-speed false-twist texturing, the twisting tension is increased to restrict occurrence of ballooning. However, if the twisting tension is excessively increased in the conventional technique, the crimp ratio of the resultant textured yarn becomes poor. In contrast, according to the method of the present invention, the twisting tension t is higher compared to the conventional method and therefore, the texturing processing can be performed stably at a high speed without ballooning.

One advantage of the fourth aspect of the present invention is that a highly stretchable textured yarn can be obtained simply by controlling the spinning and false-twist texturing steps. In short, the complicated twisting step of a low efficiency, that is indispensable in the conventional technique, is not necessary.

Another advantage of the fourth aspect is that a highly stretchable textured yarn can be produced at a high speed at the same level as the processing speed adopted in the conventional in-draw false-twist texturing method.

Still another advantage of the fourth aspect is that the kind and the type of the polymer and the denier and the filament number of the starting yarn are not substantially limited. The method of the fourth aspect can be applied to a variety of preoriented undrawn polyamide filament yarns that can be false-twisted.

The effect attained by the fifth and sixth aspects of the present invention is that the in-draw texturing process can be started stably and a high-quality false-twist textured yarn free of fluffs can be obtained even if the processing speed is increased. This effect is particularly excellent when highly oriented POY having a large denier is used. The method of these aspects can be carried out only by remodelling the entrance portion of the primary heater of the false twist texturing machine and changing the procedures of the threading operation, which does not need large expense for remodelling.

According to the apparatus of the sixth aspect of the present invention, the operation of forming a necessary yarn wrapping angle to the yarn guide elements in the midway of the threading operation can be easily performed, especially when the movable bracket is constituted to be operated with a lever from the floor level, which operation, usually, must be performed at an elevated position and needs considerable time. Moreover, a further advantage is that an excessive space is not necessary for the apparatus because it can be easily provided by remodelling an existing false-twist texturing machine.

The features of the present invention will now be more apparent with reference to the following examples that by no means limit the scope of the invention.

EXAMPLE 1

A nylon-6 chip was melted according to the ordinary method, spun at a spinning speed of 5200 m/min and directly wound on a drum to obtain a preoriented undrawn yarn (POY) having a denier of 89 and a filament number of 24. The birefringence $\Delta n$ of this POY was $39\times 10^{-3}$. The melting point of a drawn yarn obtained by fully drawing this POY was 217° C. The POY was fed to an in-draw false-twist texturing machine (MACH CRIMPER 333-II supplied by Murata Kikai K.K.), and various false-twist textured yarns were prepared by changing the processing speed, heat setting temperature and twisting tension as indicated in Table 1. The titre, strength (g/d), elongation (%), crimp recovery (%), maximum value F (g), heat treatment temperature T (°C.) providing the maximum value of the shrinkage force and melt-breakage temperature Tm (°C.) of each of the obtained false-twist texturd yarns are listed in Table 2.

Interlock knitted fabrics were prepared by using these false-twist textured yarns and were then dyed. With respect to each fabric, the stretchability in the wale direction, the appearance and the stiffness were evaluated. The obtained results are listed in Table 2. The stretchability was determined according to the following test procedures:

(1) Three test pieces having a width along the course direction of 5 cm and a length along the wale direction of about 30 cm were collected from the sample fabric.

(2) By using a constant-speed stretching tensile tester provided with an automatic recorder, the test piece was grasped at the opposite ends thereof by a pair of grips of the tester at a grip distance of 20 cm, under an initial load corresponding to the same weight as that of the sample fabric having a size of 5 cm×1 m.

(3) The test piece was stretched at a pulling speed of 20 cm/min to the point of 18 kg wt., and the grip distance was measured to the order of ½ mm. The stretchability (%) was calculated according to the following formula:

$$\text{stretchability (\%)} = l_1 - l)/l \times 100$$

wherein l stands for the initial grip distance (mm) and $l_1$ stands for the grip distance measured when stretched to the point of 1.8 kg. The mean value from three test pieces was listed in Table 2 (calculated down to the first decimal place).

From the results shown in Table 2, it will readily be understood that the false-twist textured yarn of the present invention is excellent in the stretchability, the appearance of the knitted fabric and the stiffness.

TABLE 1

| Conditions for Production of False-Twist Textured Yarns | | | | | |
|---|---|---|---|---|---|
| Run No. | Processing Speed (m/min) | False Twist Number (T/m) | Heat Setting Temperature (°C.) | Twisting Tension (g/d) | Remarks |
| 1 | 400 | 3400 | 185 | 0.21 | comparison |
| 2 | 400 | 3400 | 195 | 0.24 | comparison |
| 3 | 400 | 3400 | 205 | 0.22 | comparison |
| 4 | 600 | 3400 | 185 | 0.43 | comparison |

TABLE 1-continued

| Conditions for Production of False-Twist Textured Yarns | | | | | |
|---|---|---|---|---|---|
| Run No. | Processing Speed (m/min) | False Twist Number (T/m) | Heat Setting Temperature (°C.) | Twisting Tension (g/d) | Remarks |
| 5 | 600 | 3400 | 195 | 0.46 | present invention |
| 6 | 600 | 3400 | 205 | 0.45 | present invention |
| 7 | 800 | 3400 | 185 | 0.56 | comparison |
| 8 | 800 | 3400 | 195 | 0.53 | present invention |
| 9 | 800 | 3400 | 205 | 0.50 | present invention |
| 10 | 1000 | 3400 | 185 | 0.70 | comparison |
| 11 | 1000 | 3400 | 195 | 0.67 | present invention |
| 12 | 1000 | 3400 | 205 | 0.63 | present invention |

TABLE 2

| Properties of False-Twist Textured Yarns and Knitted Fabrics | | | | | | | | | | |
|---|---|---|---|---|---|---|---|---|---|---|
| Run No. | Titre (denier) | Strength (g/d) | Elongation (%) | CR (%) | F (g) | T (°C.) | Tm (°C.) | Stretchability (%) | Appearance of Knitted Fabric | Stiffness |
| 1 | 72.0 | 5.65 | 27.5 | 28.4 | 3.1 | 165 | 206 | 42 | good | good |
| 2 | | | | not evaluated because of extreme fused bonding | | | | | | |
| 3 | | | | | | " | | | | |
| 4 | 70.2 | 5.60 | 26.8 | 26.8 | 6.0 | 162 | 207 | 35 | slightly bad | slightly bad |
| 5 | 70.0 | 5.50 | 26.2 | 29.6 | 5.7 | 182 | 206 | 50 | good | good |
| 6 | 70.3 | 5.10 | 24.0 | 32.5 | 6.1 | 188 | 207 | 56 | good | excellent |
| 7 | 68.4 | 5.63 | 27.0 | 22.1 | 7.3 | 161 | 205 | 33 | between slightly bad and bad | slightly bad |
| 8 | 68.3 | 5.47 | 27.1 | 24.3 | 7.5 | 183 | 206 | 48 | good | good |
| 9 | 68.3 | 5.25 | 24.2 | 26.7 | 7.0 | 186 | 205 | 53 | good | good |
| 10 | 66.3 | 5.65 | 25.0 | 15.5 | 9.1 | 162 | 204 | 31 | bad | bad |
| 11 | 66.4 | 5.60 | 23.8 | 16.3 | 8.8 | 184 | 207 | 47 | good | good |
| 12 | 66.5 | 5.45 | 22.9 | 18.3 | 9.0 | 184 | 205 | 50 | good | good |

EXAMPLE 2

A nylon-6 polymer was melted according to the ordinary method and was spun at a spinning speed of 4000 m/min to obtain a POY having a denier of 87.2 and a filament number 24. An oiling agent was applied, during the spinning process, to the yarn so that the oil content of the yarn becomes 0.6 weight %. The melting point and residual ratio of the wax component used in the oiling agent are shown in Table 3.

The residual ratio referred to herein is an index indicating the durability of the wax component, which is determined according to the following method: a 200-cc beaker is charged with 150 cc of warm water heated at 60° C., and 5 g of a sample yarn is immersed in water and ultrasonic washing is carried out for 5 minutes. The washed sample is dehydrated by a spin dryer so that the water content is reduced to 50%. Then, the sample is air-dried. The amount of the wax left in the dried sample and the amount of the wax contained in 5 g of the sample before the washing treatment are measured, and the residual ratio is calculated according to the following formula:

$$\text{Residual ratio (\%)} = \frac{\text{amount of wax in sample after washing}}{\text{amount of wax in sample before washing}} \times 100$$

Figure 5:
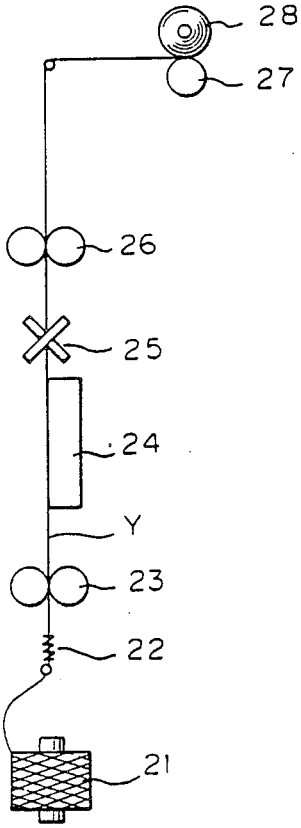
FIG. 5 is a schematic side view of a false-twist texturing machine provided with a belt nip type false-twister.

The so-obtained POY was fed to the false-twist texturing machine provided with the belt nip type friction twister, shown in FIG. 5, and the yarn was subjected to the false-twist texturing under conditions shown in Table 4. The properties of the obtained false-twist textured yarn are shown in Table 5.

The crimp recovery CR was determined according to the method described hereinbefore.

The crimp developing ability CCT (g) was determined by using a continuous crimp tester (CCT) supplied by Rothchild Co., under the following conditions:

Yarn speed: 16 m/min
Initial tension: 0.1 g/d
Overfeed ratio: 4 to 8%
Heater temperature: 150° C.

From the results shown in Table 5, it will readily be understood that false-twist textured yarns Nos. 2, 3, 4, 5, 6 and 7 according to the method of the present invention are excellent in both the crimp recovery CR and the crimp developing ability CCT. When these textured yarns were knitted into interlock knitted fabrics of 28 G and the stretchability thereof in the wale direction were measured, it was found that a high stretchability of 50 to 60% was obtained in case of the false-twist textured yarns obtained according to the method of the present invention, while the stretchability was as low as 30 to 35% in case of comparative textured yarns.

TABLE 3

| Oiling Agents Used | | | |
|---|---|---|---|
| Oiling Agent No. | Wax Component | Melting Point (°C.) of Wax Component | Residual Ratio (%) |
| 1 | polyethylene wax | 103 | 89 |
| 2 | oxidized paraffin wax | 92 | 70 |
| 3 | paraffin wax | 60 | 9 |
| 4 | not added | — | — |

TABLE 4

| False-Twist Texturing Conditions | | |
|---|---|---|
| Processing Level | Belt Crossing Angle (degrees) of Twister | Belt Speed/Processing Speed |
| A | 110 | 1.35 |
| B | 110 | 1.50 |
| C | 120 | 1.45 |
| D | 120 | 1.60 |
| E | 130 | 1.65 |
| F | 130 | 1.80 |

False-twist texturing processing speed: 600 m/min
Heater temperature: 185° C.
Draw ratio: 1.844

TABLE 5

| Results of False-Twist Texturing Processing | | | | | | | | |
|---|---|---|---|---|---|---|---|---|
| Run No. | Oiling Agent No. | Processing Level | False Twist Number (T/m) | Twisting Tension (g) | Detwisting Tension (g) | CR (%) | CCT (g) | Remarks |
| 1 | 1 | A | 3290 | 24 | 31 | 46.7 | 2.45 | comparison |
| 2 | 1 | B | 3450 | 28 | 16 | 51.0 | 2.60 | present invention |
| 3 | 1 | C | 3610 | 23 | 35 | 55.9 | 2.75 | present invention |
| 4 | 1 | D | 3720 | 25 | 28 | 57.3 | 2.80 | present invention |
| 5 | 1 | E | 3880 | 22 | 26 | 58.6 | 2.90 | present invention |
| 6 | 1 | F | 4060 | 26 | 14 | 58.3 | 2.90 | present invention |
| 7 | 2 | D | 3740 | 27 | 29 | 54.4 | 2.65 | present invention |
| 8 | 3 | D | 3730 | 27 | 28 | 45.4 | 2.45 | comparison |
| 9 | 4 | D | 3780 | 26 | 30 | 44.1 | 2.40 | comparison |

Incidentally, the belt nip type friction twister used in Example 2 was as shown in FIG. 5. The tension of the feed yarn Y supplied from a spool 21 was adjusted by the tension compensator 22, and then, the yarn Y was heated and false-twisted between the feed roller 23 and delivery roller 26. Namely, the running yarn Y was heated and false-twisted between the feed roller 23 and delivery roller 26. Namely, the running yarn Y was false-twisted by the crossing belts 25 and was simultaneously heated by the heater 24, whereby the false-twist texturing processing was accomplished. Then, the yarn Y was fed out by the delivery roller 26 and wound in a package 28 by the winding drum 27.

In the foregoing embodiment, another delivery roller may be arranged subsequently to the delivery roller 26, and known process such as filament entanglement or filament looping may be carried out between the two delivery rollers.

EXAMPLE 3

A POY (natural draw ratio of 1.33) of nylon-6 spun at a spinning speed of 5200 m/min, having a denier of 70 (after drawing at a draw ratio of 1.28) and a filament number of 24, was subjected to the false-twist texturing at a processing speed of 600 m/m, a primary heater temperature of 185° C. and a false twist number of 3390 T/m by using the draw-texturing machine shown in FIGS. 2 and 3. The twist stopprng systems shown in Table 6 were alternatively utilized. The draw ratio was slightly increased or decreased from a standard value of 1.28 to change the twisting tension and the number of fluffs on the false-twist textured yarn was measured by a fluff counter (Model DT-104 supplied by Toray Engineering K.K.). The number of fluffs per 2000 m of the false-twist textured yarn is shown in Table 6.

From the results shown in Table 6, it is seen that according to the method of the present invention, fluffs are not formed at all under a twisting tension of 20 to 25 g. On the other hand, it is seen that when conventional vane tensors supplied by A Co. and B Co. are used, the number of fluffs is prominently increased with increase of the twisting tension.

TABLE 6

| Numbers of Fluffs (per 2000 m) of Textured Yarns | | | |
|---|---|---|---|
| | | Comparative Example | |
| Twisting Tension (g) | Present Invention (Total wrapping angle = 360°) | Vane Tensor Supplied by A Co. | Vane Tensor Supplied by B Co. |
| 20 | 0 | 1.2 | 18 |
| 22.5 | 0 | 18 | 109 |
| 25 | 0 | 110 | 275 |

EXAMPLE 4

The test was carried out in the same manner as in Example 3 while fixing the twisting tension to 25 g and changing the number of yarn guide elements, the distance between the entrnace of the primary heater and the nearest yarn guide element, the distance between the adjacent yarn guide elements and the total wrapping angle as indicated in Table 7. Other conditions were the same as in Example 3. The test results are listed in Table 7. In Run No. 1, the yarn was wound on only one yarn guide element at a total wrapping angle of 360 degrees. In this case, many fluffs were formed and the threading operation was difficult. In Run Nos. 2 through 14, fluffs were hardly formed and the threading operation could be performed smoothly. However, when the distance between the primary heater and the nearest yarn guide element was larger than 200 mm, ballooning was caused and the processing became unstable (Run No. 7). Similar undesirable results were obtained when the distance between the adjacent yarn guide elements was larger than 200 mm (Run No. 10) and when the wrapping angle was less than 300 degrees (Run No. 11).

In conclusion, Run Nos. 2 to 6, 8, 9, 12, 13 and 14 satisfying the conditions of the present invention represented a desired results.

TABLE 7

| Run No. | Number of Yarn Guide Elements | Distance (mm) between Entrance of Primary Heater and Yarn Guide Element | Distance (mm) between Yarn Guide Elements | Total Wrapping Angle (degrees) | Number (per 2000 m) of Fluffs | Ballooning | Threading Operation | Remarks |
|---|---|---|---|---|---|---|---|---|
| | | | | Test Results | | | | |
| 1 | 1 | 120 | 40 | 360 | 37 | not caused | difficult | comparison |
| 2 | 2 | 120 | 40 | 360 | 2.0 | not caused | easy | present invention |
| 3 | 4 | 120 | 40 | 360 | 0 | not caused | easy | present invention |
| 4 | 5 | 120 | 40 | 360 | 0.1 | not caused | easy | present invention |
| 5 | 4 | 50 | 40 | 360 | 0 | not caused | easy | present invention |
| 6 | 4 | 190 | 40 | 360 | 0 | slight | easy | present invention |
| 7 | 4 | 220 | 40 | 360 | 0.2 | caused | easy | comparison |
| 8 | 4 | 120 | 60 | 360 | 0 | not caused | easy | present invention |
| 9 | 4 | 120 | 190 | 360 | 0.1 | slight | easy | present invention |
| 10 | 4 | 120 | 220 | 360 | 0.2 | caused | easy | comparison |
| 11 | 4 | 120 | 40 | 270 | 0 | prominent | easy | comparison |
| 12 | 4 | 120 | 40 | 300 | 0 | slight | easy | present invention |
| 13 | 4 | 120 | 40 | 310 | 0.1 | slight | easy | present invention |
| 14 | 4 | 120 | 40 | 450 | 0.3 | not caused | slightly difficult | present invention |

We claim:

1. A method for producing a false-twist textured yarn from a starting continuous polyamide filament yarn by a false-twist texturizing machine, characterized in that the birefringence n of said filament yarn to be fed to said texturing machine, the yarn tension t (g/d) in the twisting zone of said texturing machine and the heat setting temperature H(°C.) are defined by the following equations:

$$\Delta n \geqq 35 \times 10^{-3}$$

$$0.8 \geqq t \geqq 0.4$$

$$Hm - 10 \geqq H \geqq H \geqq Hm - 25,$$

wherein Hm is the melting point (°C.) of said filament yarn after it is fully drawn.

2. A method according to claim 1, wherein said filament yarn is a yarn melt-spun under of a take-up speed of more than 4,000 m/min.

3. A method according to claim 1, wherein the false-twister of said false-twist texturing machine is of a friction type selected from the group comprising a disc type twister having a yarn contacting outer surface and a belt type twister.

4. A method according to claim 1, wherein the texturing process is carried out under a condition that the ratio of the yarn tension in the detwisting zone relative to that in the twisting zone is less than 1.2.

5. A method according to claim 1 wherein the processing speed of said false-twist texturing machine is in a range of from 600 m/min to 1,000 m/min.

6. a method for producing a false-twist textured yarn from a preoriented undrawn continuous polyamide filament yarn by a false-twist texturing machine, said filament yarn having a birefringence $\Delta n$ of more than $35 \times 10^{-3}$ and being treated by a cohesive lubricating agent containing a wax having a high melting point, characterized in that the method is carried out by an in-draw texturing system utilizing a false twister of a belt nip type under false twist condition of $$N \cdot \sqrt{D} \geqq 28{,}000,$$

wherein N is the false twist number (t/m), and D is the total denier of the resulting textured yarn.

7. A method according to claim 6 wherein said wax has a melting point of more than 90° C.

8. A method according to claim 7, wherein said wax is selected from the group consisting of polyethylene wax, polypropylene wax, oxidized parrafin, microcrystal wax.

9. A method according to claim 6, wherein the weight content of said wax relative to the total of said cohesive lubricating agent is more than 3%.

* * * * *

UNITED STATES PATENT AND TRADEMARK OFFICE

CERTIFICATE OF CORRECTION

PATENT NO. : 4,773,206

DATED : September 27, 1988

INVENTOR(S) : Teiryo Kojima, Heiichiro Matsuda & Masaru Tokizane

It is certified that error appears in the above-identified patent and that said Letters Patent is hereby corrected as shown below:

Column 16, line 3, kindly delete "Namely, the running yarn Y was", line 4, kindly delete "heated and false-twisted between the feed roller 23 and", line 5, kindly delete "delivery roller 26."

Signed and Sealed this

Twenty-second Day of May, 1990

*Attest:*

*Attesting Officer*

HARRY F. MANBECK, JR.

*Commissioner of Patents and Trademarks*